US005103199A

United States Patent [19]

Ootsuka

[11] Patent Number: 5,103,199

[45] Date of Patent: Apr. 7, 1992

[54] ELECTROMAGNETIC CONTACTOR

[75] Inventor: Shigeharu Ootsuka, Nagoya, Japan

[73] Assignee: Mitsubishi Denki Kabushiki Kaisha, Tokyo, Japan

[21] Appl. No.: 578,253

[22] Filed: Sep. 6, 1990

[30] Foreign Application Priority Data

Sep. 25, 1989 [JP] Japan ..... 1-248572

[51] Int. Cl.[5] ..... H01H 67/02

[52] U.S. Cl. ..... 335/133; 335/202

[58] Field of Search ..... 335/78-85, 335/132-136, 160, 159, 161, 202

[56] References Cited

U.S. PATENT DOCUMENTS 3,342,958 9/1967 Arneberg ..... 335/160
4,490,701 12/1984 Dietrich et al. ..... 335/78
4,506,245 3/1985 Lerude et al. ..... 335/160

FOREIGN PATENT DOCUMENTS 62-54449 4/1987 Japan .
63-187523 8/1988 Japan .

*Primary Examiner*—Leo P. Picard
*Assistant Examiner*—Lincoln Donovan
*Attorney, Agent, or Firm*—Burns, Doane, Swecker & Mathis

[57] ABSTRACT

A pair of electromagnetic contactors having an interlock mechanism provides projections (11*a*, 11*b*) which are formed to project in a direction toward the case (30) where an electromagnetic part (A) is provided, and an interlock pin (60) is placed between the projections (11*a*, 11*b*), and is provided to have some interval from the contact parts (B, B'); thereby prohibiting simultaneous closing of both of the electromagnetic contactors (300*a*, 300*b*).

16 Claims, 9 Drawing Sheets

ELECTROMAGNETIC CONTACTOR

FIELD OF THE INVENTION AND RELATED ART STATEMENT

1. Field of the Invention

The present invention relates to an electromagnetic contactor having an interlock mechanism, for instance, to prevent maloperation in a reversibly operating electric apparatus, such as a motor, and so on.

2. Description of the Related Art

FIGS. 7 to 9 show a conventional reversible type electromagnetic contactor which is shown in Japanese Official Gazette of unexamined Utility model Publication No. Sho 62-54449. FIG. 7 is a perspective view showing the conventional electromagnetic contactor unit exploded, FIG. 8 is a partial diagrammatic view showing an interlock mechanism for interlocking operation in the electromagnetic contactor of FIG. 7, and FIG. 9 is a perspective view of a part of the electromagnetic contactor for showing a manner of assembling the part of the interlock mechanism of FIG. 7.

FIG. 7 shows two electromagnetic contactors 200*a*, 200*b* which are mounted on a fitting plate 100 with bolts 90 in the opposite direction, as the reversible type electromagnetic contactor unit 200. The electromagnetic contactors 200*a* and 200*b* has cases 30*a* and 30*b*, respectively, which are fixed to the fitting plate 100 and contain electromagnetic units therein, respectively, and covers 20*a* and 20*b* which are attached to the cases 30*a* and 30*b* to cover the upside case 30*a*, 30*b*. These covers 20*a*, 20*b* have connecting terminals 91*a*, 91*b* for connecting to an apparatus to be controlled. Also, a cover plate 80 is attached on two electromagnetic contactors 200*a* and 200*b* to fix the predetermined interval between them. The cover plate 80 has plural fingers 81 for engaging with plural holes 82 of the cover 20*a*, 20*b*, as shown in FIG. 7. And, an interlock pin 600 is provided between two electromagnet contactors 200*a*, 200*b*.

As shown in FIG. 8, the interlock pin 600 for interlocking between two electromagnetic contactors 200*a*, 200*b* is provided to be slidably supported by two holes 66*a*, 66*b* of the covers 20*a*, 20*b*. Numerals 65*a*, 65*b* show two slide faces to be slid by the interlock pin 600.

Both ends of the interlock pin 600 face two crossbars 10*a* and 10*b* which are provided in the electromagnetic contactors 200*a* and 200*b*, respectively. Crossbars 10*a* and 10*b* which are fit with plural movable contacts 15*a*, 15*b* are slidably provided in the covers 20*a* and 20*b*, respectively (right and left direction which is shown with arrows X and Y in FIG. 8). By operating either crossbar 10*a* or 10*b* in the right or left direction, these movable contacts 15*a*, 15*b* are closed or opened to the fixed contacts 17*a* or 17*b*, which are fixed to the cases 20*a* and 20*b*.

Next, operation of the above-mentioned reversible type electromagnetic contactor unit 200 is described with reference to FIG. 8.

FIG. 8 shows a state where the electromagnetic contactor unit 200 is not actuated, that is, two electromagnetic contactors 200*a* and 200*b* are kept in mutually off state. In this state shown by FIG. 8, when an electromagnet coil of the right electromagnetic contactor 200*a* is energized, the crossbar 10*a* of the electromagnetic contactor 200*a* is slid to a direction shown with an arrow Y in FIG. 8. As a result, the movable contacts 15*a* which are attached to the crossbar 10*a* are contacted to the fixed contact 17*a*, and contact parts of the right electromagnetic contactor 200*a* becomes ON-state. At that time, a left end of the crossbar 10*a* pushes the interlock pin 600 in a direction shown with an arrow Y, and the left end of the interlock pin 600 almost contacts the other crossbar 10*b* of the left electromagnetic contactor 200*b*. In the above-mentioned state, wherein the interlock pin 600 almost is abutting on the crossbar 10*b*, when an electromagnet of the left electromagnetic contactor 200*b* is energized, the crossbar 10*b* of the left electromagnetic contactor 200*b* is actuated to slide in a direction shown by an arrow X in FIG. 8. But, the crossbar 10*b* is stopped because of its contacting to the left end of the interlock pin 600. Namely, the starting attraction force in the left electromagnetic contactor 200*b* is less than the attraction force in the right electromagnetic contactor 200*a* after the crossbar 10*a* had been slid to close these contacts. Therefore, contact parts of the left electromagnetic contactor 200*b* do not become ON-state.

As above-mentioned, either of the right electromagnetic contactor 200*a* or left electromagnetic contactor 200*b* becomes ON-state by using the interlock pin 600 as a mechanical interlocking member. Then the interlock pin 600 is inserted to one hole 66*a* or 66*b* of the electromagnetic contactor 200*a* or 200*b* (as shown with an arrow Z in FIG. 9), and inserted to the other hole 66*a* or 66*b* when the other electromagnetic contactor 200*b* or 200*a* is mounted on the fitting plate 100.

In the above-mentioned conventional reversible type electromagnetic contactor unit 200, substantial center lines of the interlock pin 600 and two crossbars 10*a*, 10*b* are alined on the same line which is parallel to each operation direction, as shown in FIG. 8. And, the interlock pin 600 is supported at its both sides by two slide faces 65*a* and 65*b* of the covers 20*a* and 20*b*. Thus, two covers 20*a* and 20*b* of the electromagnetic contactors 200*a* and 200*b*, respectively, must be placed to have some interval between them, so as to stably support and smoothly slide the interlock pin 600.

Also, the interlock pin 600 and the holes 66*a* and 66*b* of the covers 20*a* and 20*b* are deformed and worsened in insulation because of that the interlock pin 600 and the holes 66*a* and 66*b* are provided near the contact parts where electric arc is generated at the breaking time of them. And, if the right electromagnetic contactor 200*a* and the left electromagnetic contactor 200*b* are mounted closely, there is liable to be a short between a right end of the contact parts in the left electromagnetic contactor 200*b* and a left end of the contact parts in the right electromagnetic contactor 200*a* through the interlock pin 600 in the holes 66*a*, 66*b* owing to the worsened parts in insulation. Therefore, two covers 20*a* and 20*b* of the right electromagnetic contactor 200*a* and the left electromagnetic contactor 200*b*, respectively, must be mounted to have also some space between them.

OBJECT AND SUMMARY OF THE INVENTION

An object of the present invention is to provide an electromagnetic contactor which has a reliable interlocking mechanism, and is manufactured in small size and bulk.

In order to achieve the above-mentioned object, the electromagnetic contactor of the present invention comprises:

a casing containing an electromagnet unit and an operation unit to be operated by the electromagnet unit;

a crossbar which is contained in a cover mounted on an upper fitting face of the casing and is to be slidably operated in a direction parallel to the upper fitting face by moving the operation unit; and a projection which is fixed to the crossbar contained by the casing, projects in a direction toward the casing, and has a contact part for receiving at contacting with an interlock member to slide the crossbar.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 1 is a cross-sectional side view showing the electromagnetic contactor of the first embodiment.

FIG. 2 is an exploded perspective view showing the electromagnetic contactor of FIG. 1.

FIG. 3 is a cross-sectional side view showing a part of the electromagnetic contactor of FIG. 1.

It will be recognized that some or all of the Figures are schematic representations for purposes of illustration and do not necessarily depict the actual relative sizes or locations of the elements shown.

DESCRIPTION OF THE PREFERRED EMBODIMENTS

Hereafter, a first embodiments of the present invention are described with reference to the accompanying drawings.

Figure 1:
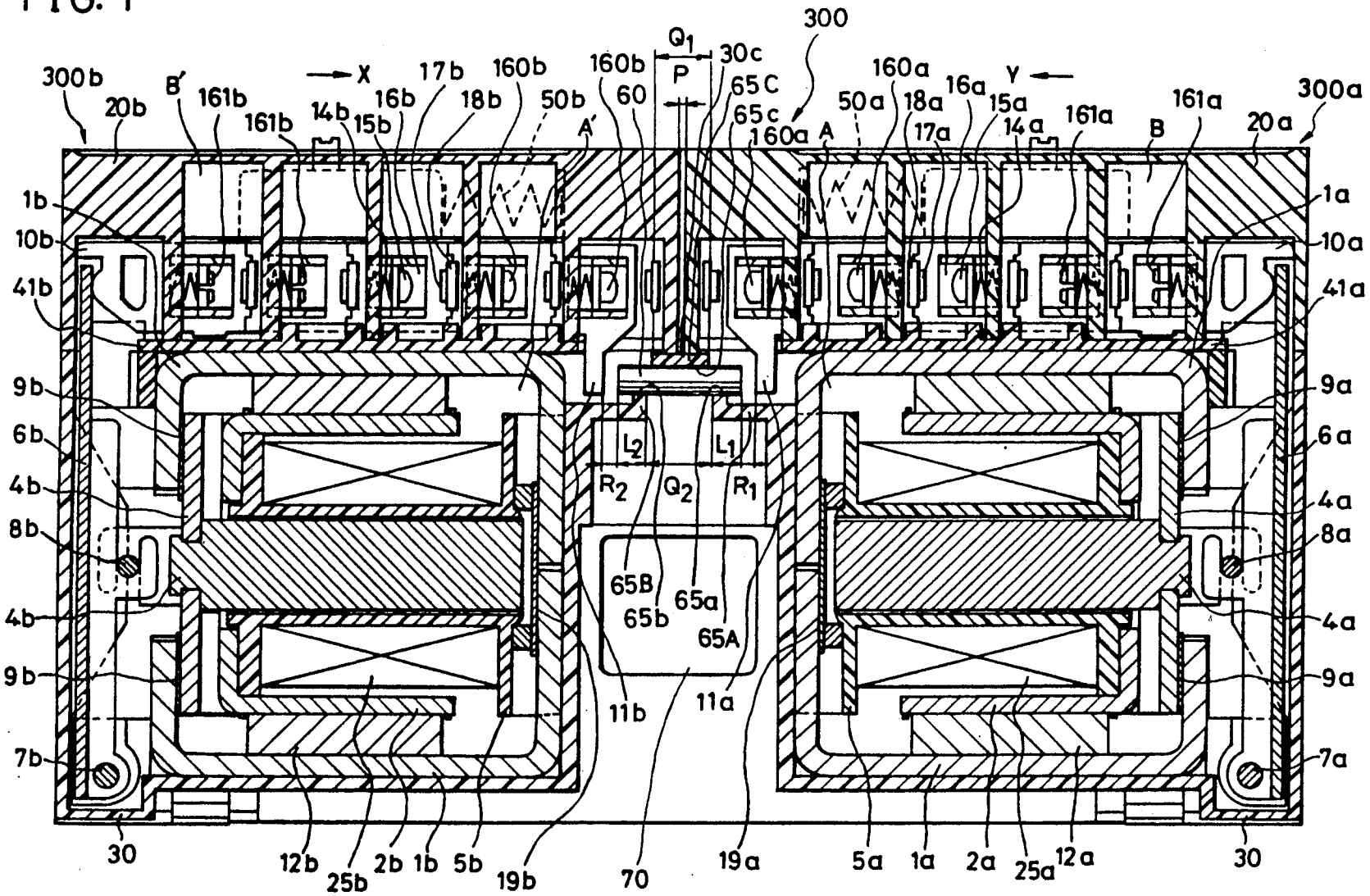
FIGS. 1 to 3 show a first embodiment of an electromagnetic contactor of the present invention.

FIG. 1 is a cross-sectional side view showing a reversible type electromagnetic contactor 300 of the present invention. In FIG. 1, two C-shaped fixed iron plates 1*a* and 1*b*, two L-shaped magnetic pole plates 2*a* and 2*b* and two coil spools 5*a* and 5*b* on which coils 25*a* and 25*b* are wound to constitute two electromagnet parts A and A', respectively, and are symmetrically fixed on both sides in a case 30. Permanent magnets 12*a*, 12*b* are provided between the fixed iron plates 1*a*, 1*b* and the magnetic pole plates 2*a*, 2*b* in order to assist the attraction by the electromagnet units, respectively. These permanent magnets 12*a*, 12*b* also improve a performance to withstand the mechanical shock from the outside. Two movable iron cores 4*a* and 4*b* of which each end is formed in T-shaped are slidably mounted to the case 30 in a right and a left directions in FIG. 1. The end of movable iron cores 4*a* and 4*b* are engaged with links 6*a* and 6*b* via linkage pins 8*a*, 8*b*, respectively. The links 6*a*, 6*b* are provided in the case 30 to turn around a fulcrum pins 7*a*, 7*b*, respectively. In the right electromagnet and the left electromagnet, first spacers 9*a*, 9*b* of ring-shape and second spacers 19*a*, 19*b* of disk-shape are provided on both ends of respective movable iron cores 4*a*, 4*b* in order to adjust operation strokes of the movable iron cores 4*a*, 4*b* and attraction force of the electromagnets, respectively. The above-mentioned parts, that is, the fixed iron plates 1*a*, 1*b*, the magnetic pole plates 2*a*, 2*b*, the movable iron plates 4*a*, 4*b*, the coil spools 5*a*, 5*b* and coils 25*a*, 25*b* etc., constitute the electromagnet parts A and A' within the case 30.

Crossbars 10*a*, 10*b* are for engagement with the upside parts of the links 6*a*, 6*b* to slide by turning operation of the links 6*a*, 6*b*. By the sliding operation of the crossbars 10*a*, 10*b*, movable contact arms 16*a*, 16*b* are carried toward fixed contact arms 18*a*, 18*b*, respectively. The movable contact arms 16*a*, 16*b* have movable contacts 15*a*, 15*b* to be contacted to fixed contacts 17*a*, 17*b* of the fixed contact arms 18*a*, 18*b*. The movable contacts 15*a* and 15*b* and the fixed contacts 17*a* and 17*b* are contacted to or detached from by sliding the crossbars 10*a*, 10*b* in a right side or a left side direction in FIG. 1, respectively. The fixed contact arms 18*a*, 18*b* having the fixed contacts 17*a*, 17*b* are fixed to the covers 20*a*, 20*b*, respectively.

The movable contact arms 16*a* and 16*b* are supported by the crossbars 10*a* and 10*b* to slide at some intervals within the crossbars 10*a*, 10*b*, and are urged by compression springs 14*a*, 14*b* in order to give a contacting pressure to the movable contacts 15*a*, 15*b*, respectively. The fixed contact arms 18*a*, 18*b* and the crossbars 10*a*, 10*b* with the movable contact arms 16*a*, 16*b* are mounted within the covers 20*a*, 20*b* which are mounted on the upper fitting face 1000 of the case 30, integrally. These components mounted in the covers 20*a*, 20*b* constitute contact parts B and B' disposed above the above-mentioned electromagnet parts A and A', respectively. The contact parts B and B' are isolated from the electromagnet parts A and A' by shielding plates 41*a* and 41*b*, respectively. The shielding plates 41*a*, 41*b* are made of flat insulation Board e.g. synthetic resin. Two crossbars 10*a* and 10*b* are urged in an opposite direction to keep these contacts open state by compression springs 50*a* and 50*b*, respectively.

The crossbars 10*a*, 10*b* which are made of insulation material have projections 11*a*, 11*b* which are formed to project in a downward direction as shown in FIG. 1, respectively. The projections 11*a*, 11*b* are formed in size and bulk as small as possible in consideration of the strength of the crossbars 10*a*, 10*b*, respectively. An interlock pin 60 which is placed between the projections 11*a* and 11*b* is provided to interlock the operation of the projections 11*a* and 11*b*.

The interlock pin 60 is inserted in a hole 66 which is formed on the substantial center part of the case 30, and which is constituted by three slide faces 65*a*, 65*b*, and 65*c* to be slid by the interlock pin 60. The three slide faces 65*a*, 65*b* and 65*c* are provided on three interlock pin holders 65A, 65B and 65C. A through-hole 70 for wiring is formed under the hole 66 as shown in FIG. 1, and consequently a control panel etc. mounted on the electromagnetic contactor 300 is easily and neatly wired.

Figure 2:
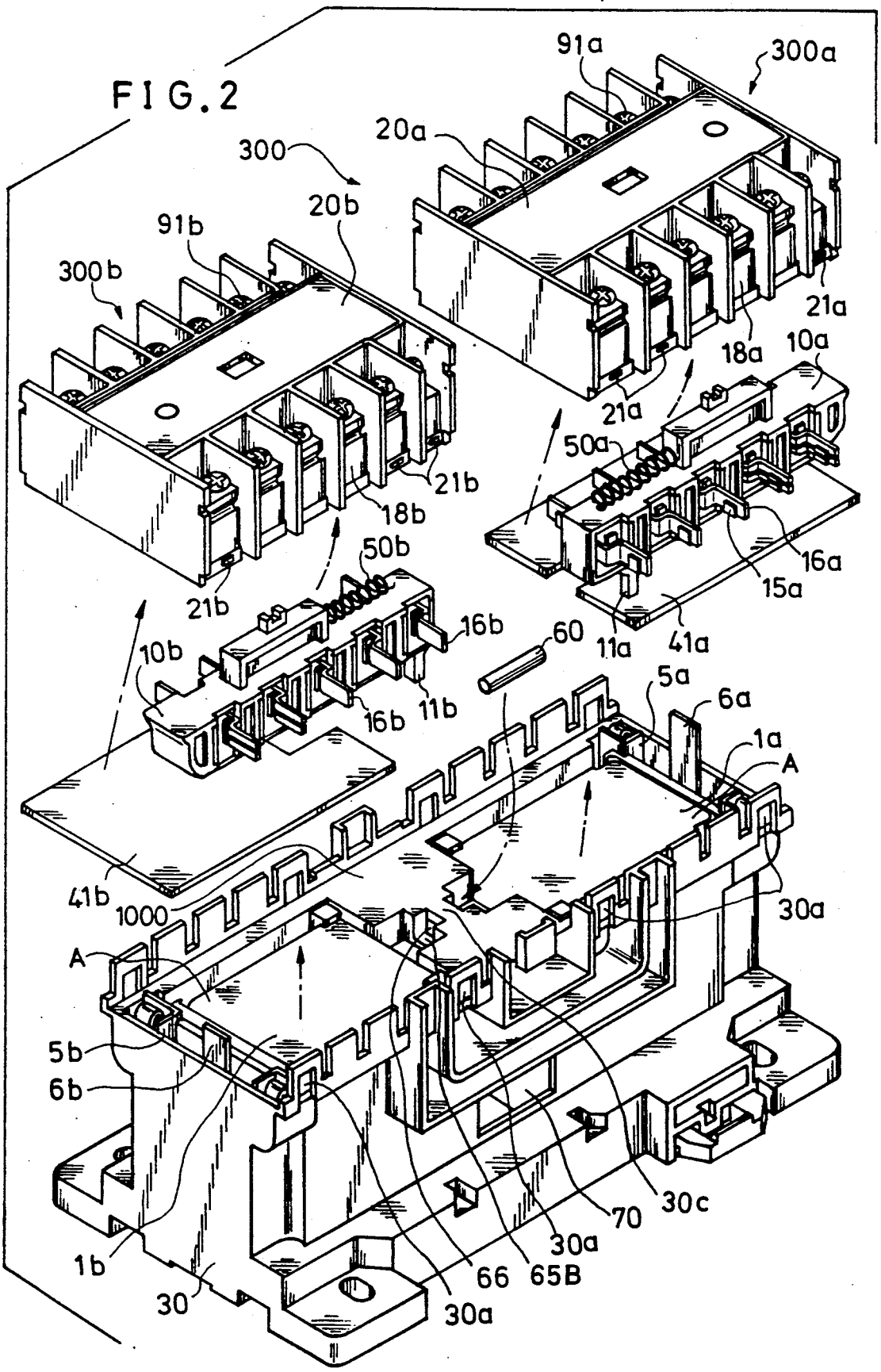

FIG. 2 is an exploded view in perspective of the reversible type electromagnetic contactor 300. In FIG. 2, the interlock pin 60 is contained in the hole 66 which is formed by the slide faces 65*a*, 65*b*, 65*c* in the substantial center part of the case 30 which contains the two electromagnet parts A and A'. First, the interlock pin 60 is inserted to the hole 66 of the case 30. And, the shielding plates 41*a* and 41*b* are mounted on the fixed iron plates 1*a* and 1*b*, respectively. Finally, the covers 20*a* and 20*b* including the crossbars 10*a* and 10*b* with movable contacts 15*a* and 15*b* are mounted onto the case 30, respectively such that the crossbars 10*a* and 10*b* are slidable in directions Y and X parallel to the fitting face 1000. At the time, the interlock pin 60 is placed between the right side projection 11*a* of the crossbar 10*a* and the left side projection 11*b* of the crossbar 10*b*. And, appendixes 21*a* and 21*b* which are provided on the covers 20*a* and 20*b* engage with holes 30*a* which are provided on the case 30, and consequently the covers 20*a* and 20*b* are accurately and surely mounted on the case 30, respectively. The two covers 20*a* and 20*b* and the case 30 are thereby united in one body. Thus, the parts of the electromagnet parts A, A' are accurately engaged with the part of the contact parts B, B' in the covers 20*a* and 20*b*, respectively. Namely, upside parts of the links 6*a* and 6*b* are surely engaged with each end of the crossbars 10*a* and 10*b*, and the interlock pin 60 is placed between the projections 11*a*, 11*b*, respectively.

Figure 3:
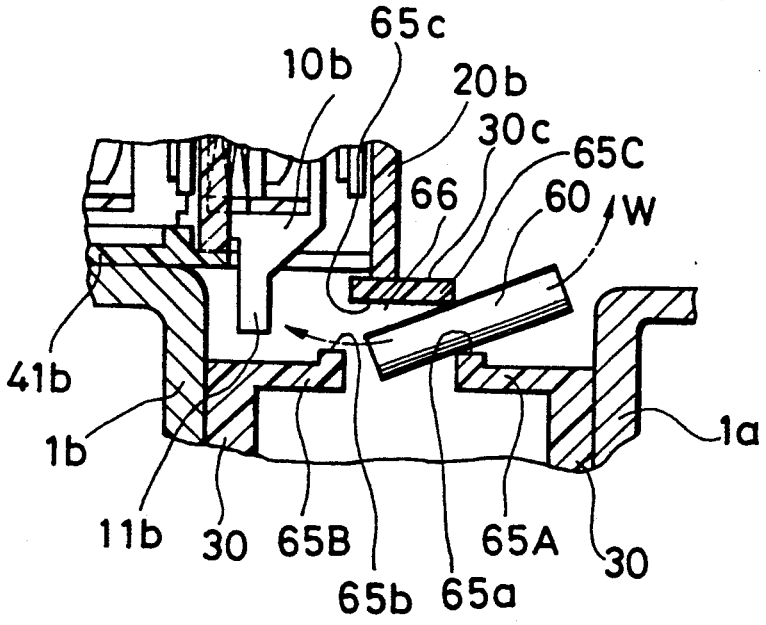

FIG. 3 is a partial cross-sectional view showing the case that the interlock pin 60 is inserted or removed from the hole 66 of the case 30 in an assembling step. Namely, after mounting one cover 20*a* or 20*b* on the case 30, the assembling is made such that the interlock pin 60 is inserted or removed from the hole 66 by the swing action of the interlock pin 60 as shown with an arrow W. And, the other cover 20*b* or 20*a* is mounted on it to finish the assembling step for the reversible type magnetic contactor 300.

Next, operation of the above-mentioned embodiment of electromagnetic contactor 300 is described.

FIG. 1 shows a state where the reversible type electromagnetic contactor 300 is not actuated. Namely, both of the electromagnets in the electromagnetic parts A and A' are not actuated at the state shown in FIG. 1. In the above-mentioned state, when the electromagnetic coil 25*a* of the right electromagnetic contactor 300*a* is energized, the movable core 4*a* of the right electromagnetic contactor 300*a* is slid in a direction shown with an arrow Y in FIG. 1. And, the right crossbar 10*a* is also slid to the direction of the arrow Y by the rotated link 6*a*.

As a result, the movable contacts 15*a* are contacted to the fixed contacts 17*a* and a current flows through these contacts. The right projection 11*a* of the crossbar 10*a* presses the interlock pin 60 in a direction of an arrow Y, and the interlock pin 60 almost abuts on the left projection 11*b* of the crossbar 10*b*. In this state, when the coil 25*b* of the left electromagnetic contactor 300*b* is energized, the crossbar 10*b* of the left electromagnetic contactor 300*b* is actuated to slide in a direction shown with an arrow X in FIG. 1. But the crossbar 10*b* is stopped because of abutting on the left end of the interlock pin 60. Namely, the starting attraction force which is generated between the movable iron core 4*b* and the fixed iron plate 1*b* is less than the attraction force in the right electromagnetic contactor 300*a* after sliding of the crossbar 10*a* to close these contacts. Therefore, the movable contacts 15*b* of the left side electromagnetic contactor 300 is prevented from contacting with the fixed contact 17*b*.

As above-mentioned, either of the right or left contacts of the electromagnetic contactors 300*a* and 300*b* becomes ON-state. The right electromagnetic contactor 300*a* and left electromagnetic contactor 300*b* are operated to be mechanical interlocked by using the interlock pin 60.

When the energizing power for the coil 25*a* of the right electromagnetic contactor 300*a* is cut, the movable contacts 15*a* restores to OPEN-state by the compression force of the spring 50. At the same time, the current in the right contact part B is stopped, and an electric arc is generated between the movable contacts 15*a* and the fixed contacts 17*a* in the right contact part B.

Since the interlock pin 60 is constituted to operate by the projections 11*a*, 11*b* which are made of hard insulation material and are formed to project downward from crossbar 10*a*, 10*b*, respectively, in other words since the interlock pin 60 is placed apart from the contact parts B and B', the interlock pin 60 is substantially isolated from the heat of the electric arc and hot gas of the electric arc. Thus, the deformation of the interlock pin 60 and the hole 66 to be inserted by the interlock pin 60 are prevented.

Further, as the gap between the slide faces 65*a*, 65*b*, 65*c* and the circumference of the interlock pin 60 is covered by the covers 20*a*, 20*b* and case 30, grit, such as dust or waste electric wire, is prevented to enter in it.

In FIG. 1, a length $R_1$ shows interval between the projection 11*a* of the right electromagnetic contactor 300*a* and the right end of the interlock pin 60. A length $R_2$ shows interval between the projection 11*b* of the left electromagnetic contactor 300*b* and the left end of the interlock pin 60. A length $L_1$ is the interval between the right end of the interlock pin 60 and the left end of the slide face 65*a*. A length $L_2$ is the interval between the left end of the interlock pin 60 and the right end of the slide face 65*b*. A length $Q_1$ is the length of the slide face 65*c* in a slide direction. A length $Q_2$ shows interval between two slide faces 65*a* and 65*b* of the bottom side of the hole 66.

In FIG. 1, these lengths $R_1$, $R_2$, $L_1$ and $L_2$ has the following relations;

$$R_1 < L_2 \quad (1),$$

$$R_2 < L_1 \quad (2).$$

Therefore, the interlock pin 60 never comes out of the assembled electromagnetic contactor 300. And, as shown in FIG. 3, the interlock pin 60 can be easily inserted or removed from the hole 66 by removing at least one of the covers 20*a* or 20*b*.

And the length $Q_1$ of the slide face 65*c* and the gap between slide faces 65*a*, 65*b* for bearing the interlock pin 60 thereon are designed to have the relation shown by the following inequity (3);

$$Q_1 \leqq Q_2 \quad (3).$$

Therefore, the interlock pin holder 65A, 65B and 65C are made easily by plastic resin molding. As the interlock pin 60 is slid and guided on the three slide faces 65*a*, 65*b* and 65*c*, the sliding of the interlock pin 60 is stably operated. And, a gap P between the right and left covers 20*a*, 20*b* is closed at lower end of the gap by the wall 30*c* which has the upper slide face 65*c* to be slid by the interlock pin 60. Therefore, grit is prevented to enter into the electromagnetic contactor 300 from the aperture between covers 20*a* and 20*b*.

As a result, grit does not enter in the gap between a circumferential face of the interlock pin 60 and slide faces 65*a*, 65*b* and 65*c* inside of the electromagnetic contactor 300 is kept in clean state. Therefore, the interlock pin 60 is protected from abnormally worn away to make malfunction.

Figure 8:
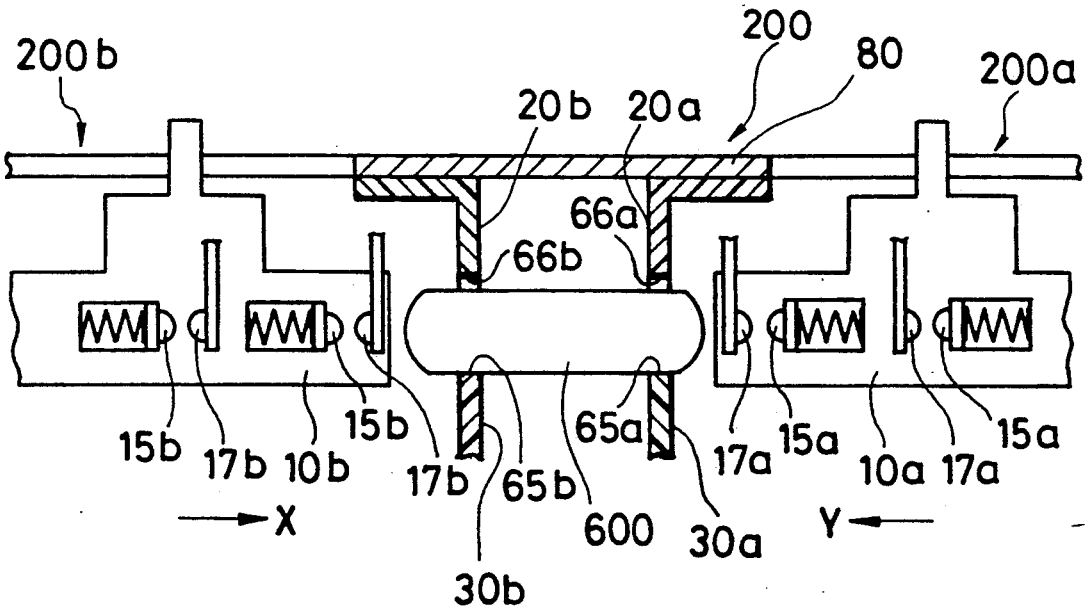
FIG. 8 (Prior Art)
FIG. 8 is the schematic cross-sectional side view showing a part of the conventional electromagnetic contactor of FIG. 7.
Figure 9:
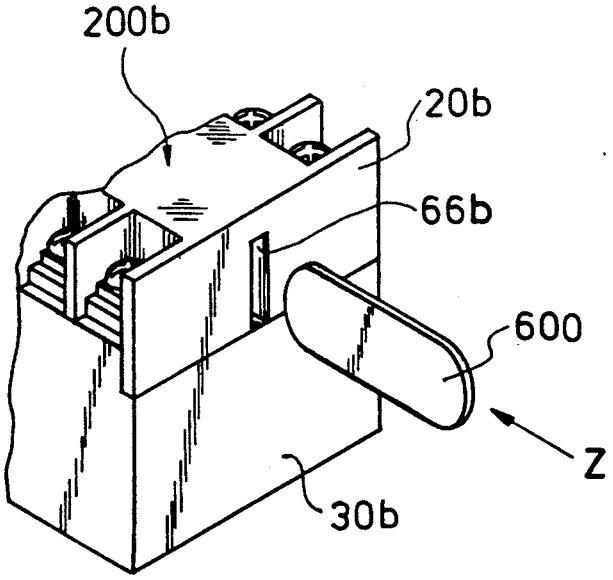
FIG.9 (Prior Art)
FIG. 9 is the perspective view showing a part of the conventional electromagnetic contactor exploded.

As the each-other opposing ends of the projections 11*a* and 11*b* are off-set from the each-other opposing ends of the crossbars 10*a* and 10*b*, there is no need of separating the each-other opposing ends of the crossbars 10*a* and 10*b* farther than the length of the interlock pin 60. Therefore, the each-other opposing end faces of the crossbars 10*a* and 10*b* can be disposed more closely than the prior art of FIG. 8.

Furthermore, since the interlock mechanism, which comprises the projections 11*a*, 11*b*, the interlock pin 60 and hole 66 etc., is provided under the covers 20*a*, 20*b*, the covers 20*a*, 20*b* receive only the contact parts B, B'. Therefore, the right and left covers 20*a*, 20*b* are placed close to or to have little gap between them, and the electromagnetic contactor 300 is manufactured in small size and bulk.

Figure 4:
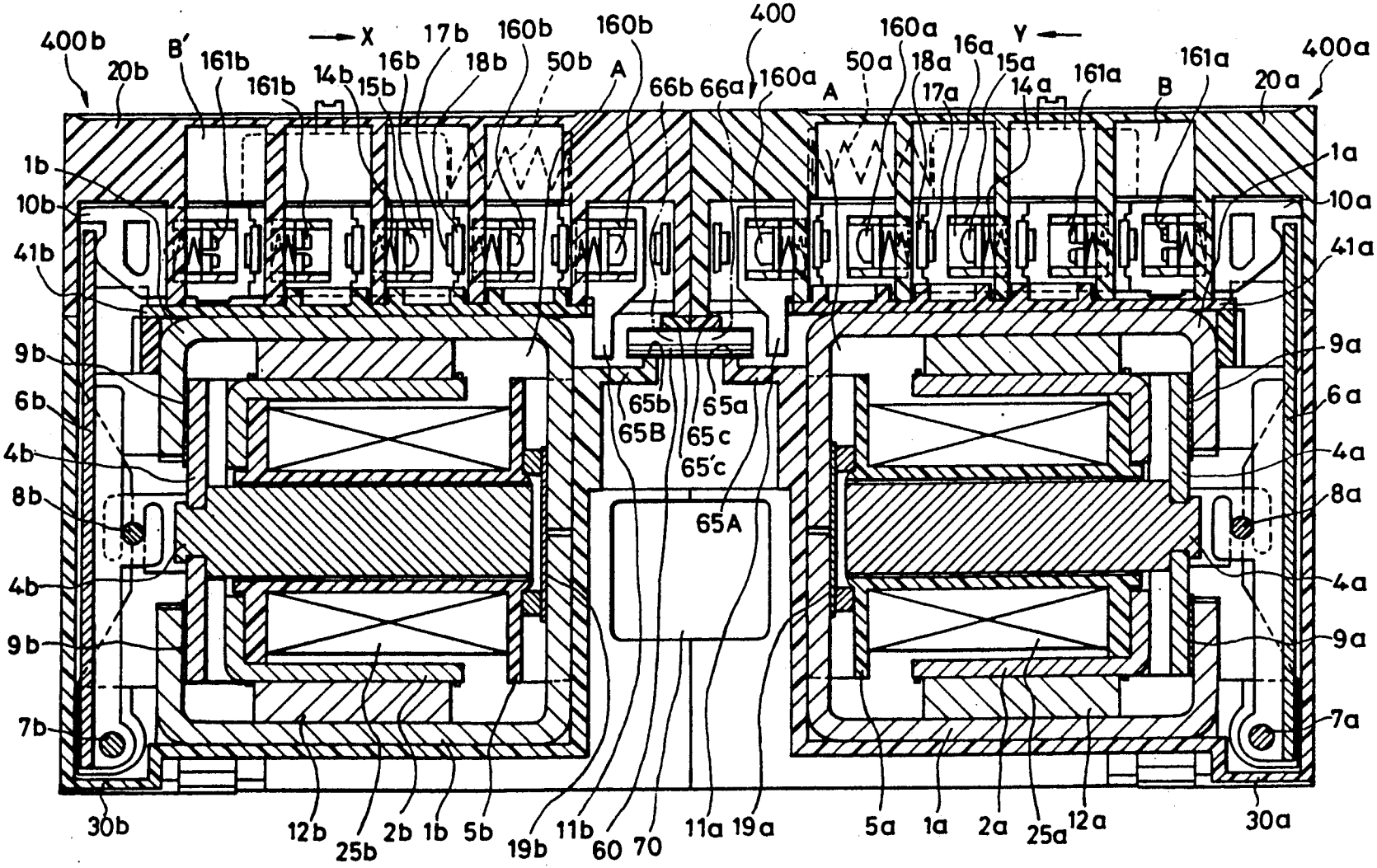
FIG. 4 is a cross-sectional side view showing a second embodiment of an electromagnetic contactor of the present invention.

Apart from the above-mentioned first embodiment wherein the case 30 containing a pair of electromagnet parts A, A' of the electromagnetic contactors 300*a*, 300*b* is integrally formed in one body, a second embodiment may be such that two cases 30*a* and 30*b* containing two electromagnet parts A and A' respectively, as shown in FIG. 4.

FIG. 4 is the cross-sectional side view showing the second embodiment of an electromagnetic contactor 400. Corresponding parts and components to the first embodiment are shown by the same numerals and marks, and the description thereon made in the first embodiment similarly apply. Differences and features of this second embodiment from the first embodiment are as follows. The reversible type electromagnetic contactor 400 comprises a right half part of an electromagnetic contactor 400*a* and a left half part of an electromagnetic contactor 400*b* which are provided tightly contacting each other as shown in FIG. 4. In the second embodiment, the interlock pin 60 is supported by the slide faces 65*a* of the interlock pin holder 65A and the slide face 65*b* of the interlock pin holder 65B, which are formed on cases 30*a*, 30*b*, respectively. And, an interlock pin 60 of the second embodiment is placed between two projections 11*a* and 11*b* which are formed to project downward from each crossbar 10*a*, 10*b*. Accordingly, the interlock pin 60 and the holes 66*a*, 66*b* are almost free from contamination by the electric arc generated in the contact parts B, and the interlock pin 60 which is supported by the slide faces 65*a*, 65*b* is stably operated, similarly to the afore-mentioned first embodiment.

Figure 5:
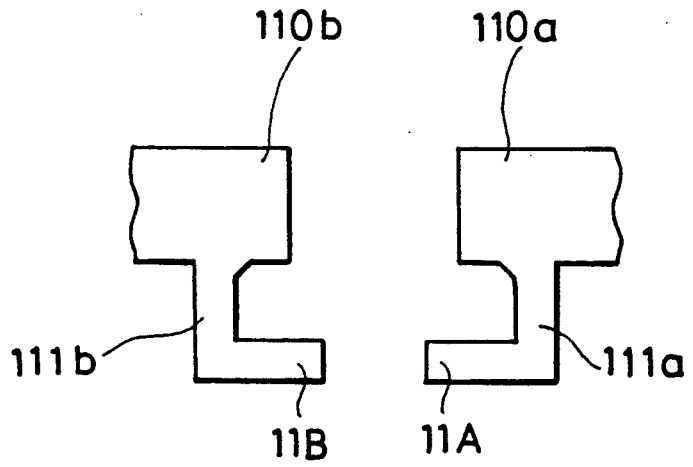
FIG. 5 is a side view showing a third embodiment of crossbars of the present invention.

Also, apart from the above-mentioned embodiments wherein the interlock pin 60 is provided between the projections 11*a*, 11*b*, a third embodiment may be such that projections 111*a*, 111*b* of the crossbar 110*a*, 110*b* are formed in L-shape as shown in FIG. 5.

FIG. 5 is a side view of the crossbar 110*a*, 110*b* with projections 111*a*, 111*b* of the third embodiment. Corresponding parts and components to the first embodiment are shown by the same numerals and marks, and the description thereon made in the first embodiment similarly apply. Differences and features of this third embodiment from the first embodiment are as follows. As shown in FIG. 5, the projections 111*a*, 111*b* are made with thick plastic plates and have the functions of the interlock pin 60 and the projections 11*a*, 11*b* in the afore-mentioned embodiments. Consequently it is not necessary provide various components to support the interlock members 11A, 11B. The electromagnetic contactor in the third embodiment is operated to interlock by directly abutting ends of the projections 111*a* and 111*b* to each other. As a result, there is no need to provide an interlock pin and a supporting parts for an interlock pin in the afore-mentioned embodiments. Therefore, the electromagnetic contactor of the third embodiment is easily assembled, because of simple configuration with more less parts than the afore-mentioned embodiments.

Figure 6:
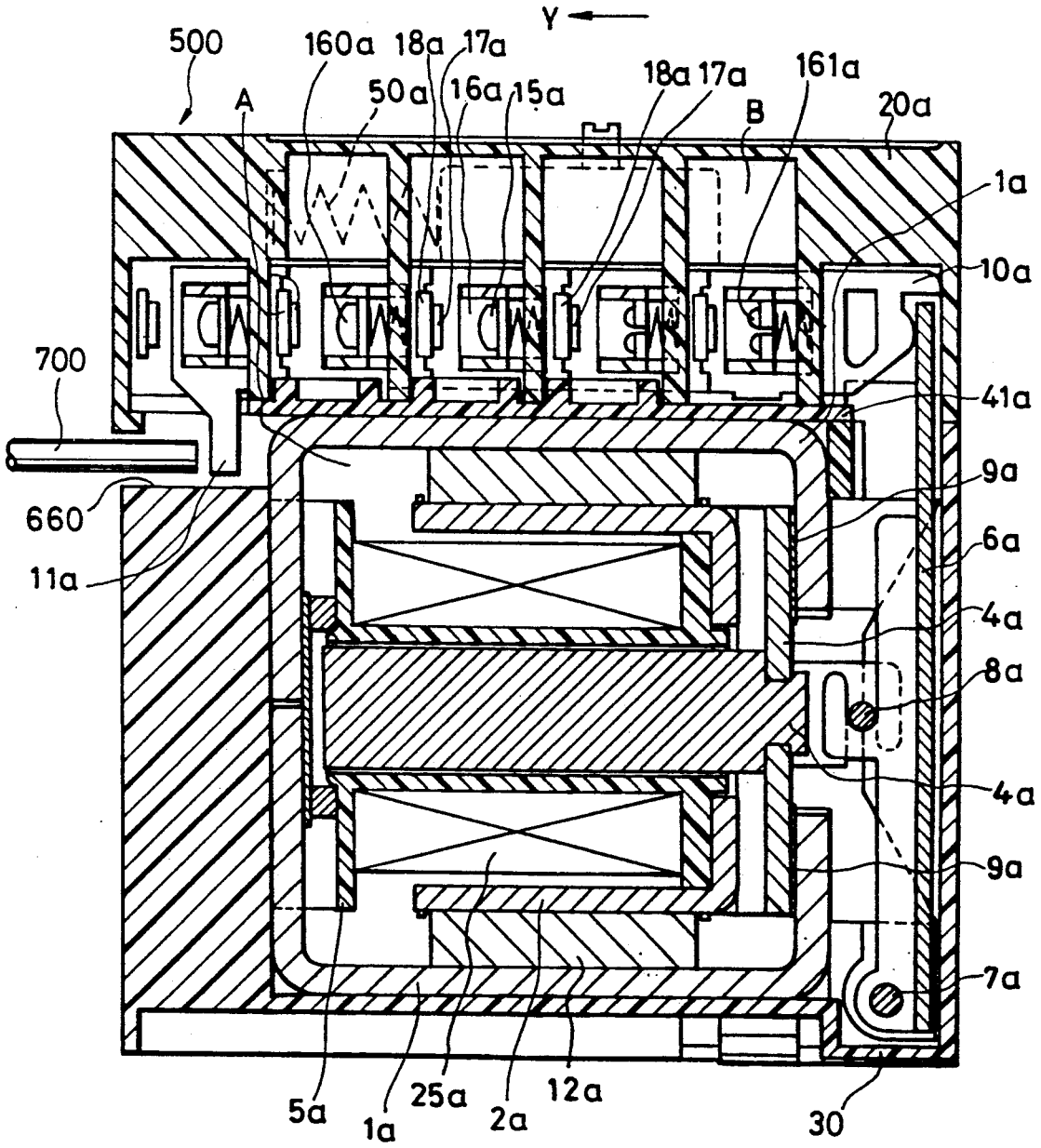
FIG. 6 is a cross-sectional side view showing a forth embodiment of an electromagnetic contactor of the present invention.
Figure 7:
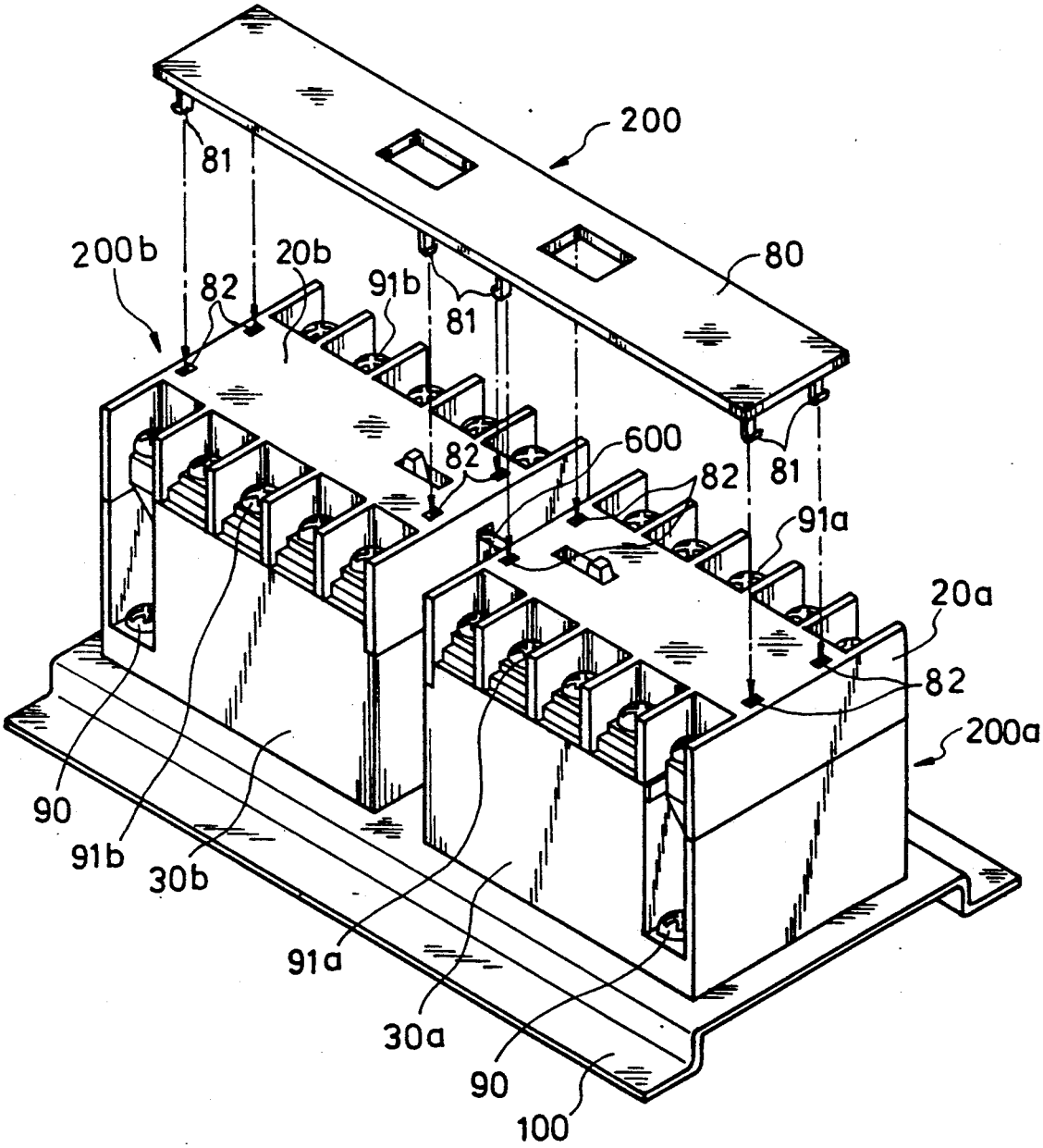
FIG.7 (Prior Art)
FIG. 7 is the perspective view showing the conventional electromagnetic contactor exploded.

Further, apart from the above-mentioned embodiments wherein the reversible type electromagnetic contactors are operated to interlock between two contact parts B and B' of the electromagnetic contactors, a fourth embodiment may be such that an electromagnetic contactor 500 has an interlock mechanism which is engage with outside interlock mechanism 700 as shown in FIG. 6.

FIG. 6 is a cross-sectional side view showing the electromagnetic contactor 500 which has an electromagnet part A, as the fourth embodiment. Corresponding parts and components to the first embodiment are shown by the same numerals and marks, and the description thereon made in the first embodiment similarly apply. Differences and features of this fourth embodiment from the first embodiment are as follows. As shown in FIG. 6, an end of a connection rod 700 of an outside interlock mechanism is inserted in a hole 660 on a case 30. The end of the connection rod 700 abuts on a projection 11*a*, which is formed inside the case 30 to project downward from the crossbar 10*a*. That is, the outside interlock mechanism which is placed apart from the contact part B, being connected by the connection rod 700 therebetween, and hence it is substantially isolated from the heat of the electric arc and hot gas of the electric arc.

Apart from the above-mentioned embodiments wherein the electromagnetic contactors have plural normaly opened contacts, a modified embodiment may be such that an electromagnetic contactor has plural normally closed contacts.

In the above-mentioned first and second embodiments, the projections 11*a*, 11*b* of the crossbars 10*a*, 10*b* are provided to project in a downward direction (forward to an upper fitting face of the case 30, 30*a*, 30*b* side), and each-other opposing ends of the projections 11*a*, 11*b*, are off-set from the each-other opposing ends of the crossbars 10*a*, 10*b*, there is no need of separating the each-other opposing ends of the crossbars 10*a*, 10*b* farther than the length of the interlock pin 60. Therefore, the electromagnetic contactor 300, 400 of the present invention is manufactured in small size and bulk. And, the electromagnetic contactor 300, 400 has reliable interlock mechanism because of that the parts of the interlock mechanism are provided apart from the contact parts B, B'.

Further, in the reversible type electromagnetic contactor 300, 400 the right and left electromagnetic contactors 300*a*, 300*b*, 400*a*, 400*b* can be provided to mount near or to close each other. Thus the size of reversible type electromagnetic contactor 300 or 400 is made small.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An electromagnetic contactor, comprising:

a casing containing an electromagnet unit and an operation unit to be operated by said electromagnet unit;

a cross bar which is contained in a cover mounted on an upper fitting face of said casing, and which is to be slidably operated in directions parallel to said upper fitting face by moving said operation units; and a projection which is fixed to said crossbar, said projection projecting in a direction toward said casing, and having a contact part for contacting an interlock member during at least a portion of said sliding operation of said crossbar.

2. An electromagnetic contactor, comprising:

a casing containing an electromagnet unit and an operation unit which is operated by said electromagnet unit;

a cover which is mounted on an upper fitting face of said casing and which contains a contactor unit and a connector unit;

a crossbar which is placed in said cover and is slidably operated in directions parallel to said upper fitting face by moving said operation unit;

an interlock member which overlaps said crossbar in a direction parallel to said upper fitting face; and a projection which is fixed to said crossbar, which projects toward said casing, and which is formed to contact said interlock member.

3. An electromagnetic contactor, comprising:

a casing containing a pair of electromagnet units and a pair of operation units which are operated by said electromagnet units;

a pair of covers, mounted on an upper fitting face of said casing, containing contactor units and connector units;

a pair of crossbars held slidably in said covers, which are to be operated in opposite directions to actuate said contactor units and are slidably operated in directions parallel to said upper fitting face by moving said operation units, said pair of crossbars having a pair of projections which are fixed to opposing ends of said crossbars and which project toward said casing; and an interlock member which is placed between said pair of projections overlapping said crossbars in a direction parallel to said upper fitting face.

4. An electromagnetic contactor in accordance with claim 1, claim 2 or claim 3, wherein said casing has slide bearing means for slidably holding said interlock member.

5. An electromagnetic contactor in accordance with claim 4, wherein said slide bearing means is a through-hole having an axis parallel with a sliding direction of said crossbar.

6. An electromagnetic contactor in accordance with claim 4, wherein said interlock member is an interlock pin.

7. An electromagnetic contactor in accordance with claim 4, wherein said projections are made of insulation material.

8. An electromagnetic contactor, comprising:

a casing made integral and containing a pair of electromagnet units and a pair of operation units which are operated by said electromagnet units;

a pair of covers, mounted on an upper fitting face of said casing, containing contactor units and connector units;

a pair of crossbars held slidably in said covers, which are to be operated in opposite directions to actuate said contactor units and which are slidably operated in directions parallel to said upper fitting face by moving said operation units, said pair of crossbars having a pair of projections which are fixed to opposing ends of said crossbars, respectively, and which project toward said casing; and an interlock member which is placed between said pair of projections overlapping said crossbars in a direction parallel to said upper fitting face, and which is supported and guided by a substantially center part of said casing.

9. An electromagnetic contactor, comprising:

a casing made integral and containing a pair of electromagnet units and a pair of operation units which are operated by said electromagnet units;

a pair of crossbars which are contained in a pair of covers mounted on an upper fitting face of said casing, and which are to be slidably operated in a direction parallel to said upper fitting face by moving said operation units; and a pair of projections which are fixed to opposing ends of said crossbars, respectively, which project toward said casing, and which include an abutting end tip member provided on at least one of said projections of one of said crossbars for abutting an end of the other of said projections to prohibit slide operation of the other of said crossbars at least when said one crossbar is fully slide-operated.

10. An electromagnetic contactor, comprising:

a casing made integral and containing a pair of electromagnet units and a pair of operation units which are operated by said electromagnet units;

a pair of crossbars which are contained in a pair of covers mounted on an upper fitting face of said casing, and which are to be slidably operated in directions parallel to said upper fitting face by moving said operation units;

a pair of projections which are fixed to opposing ends of said crossbars, respectively, and which project toward said casing;

an interlock member which is placed between said pair of projections for prohibiting slide operation of one of said crossbars at least when the other of said crossbars is fully operated, by abutting of said interlock member and said projections; and slide bearing means formed in said casing, for slidably supporting said interlock member.

11. An electromagnetic contactor in accordance with claim 9 or claim 10, wherein said pair of crossbars are placed opposing each other for operation in opposite directions.

12. An electromagnetic contactor in accordance with claim 10, wherein said interlock member is placed between said pair of projections overlapping said crossbars in a direction parallel to said upper fitting face.

13. An electromagnetic contactor in accordance with claim 10, wherein said slide bearing member is formed in said casing, and has upper slide faces which are provided on an upper part and lower slide faces provided on a lower part.

14. An electromagnetic contactor in accordance with claim 13, wherein said lower slide faces of said slide bearing member include two faces.

15. An electromagnetic contactor in accordance with claim 14, further including:

gaps which are between abutting ends of said projections and ends of said interlock member; and distances which are between said ends of said interlock member and inner ends of said lower slide faces, said gaps and distances being selected in a manner such that when one of said projections is removed said interlock member is removable by turning it in a space produced by said removing of said one projection, but when both of said projections are provided at respective operating positions, said interlock member is slidably held by said slide faces.

16. An electromagnetic contactor, comprising:

a pair of tightly coupled casings containing a pair of electromagnet units and a pair of operation units which are operated by said electromagnet units;

a pair of covers, mounted on upper fitting faces of said casings, containing contactor units and connector units;

a pair of crossbars held slidably in said covers, which are to be operated in opposite directions to actuate said contactor units and which are slidably operated in directions parallel to said upper fitting faces by moving said operation units, said pair of crossbars having a pair of projections which are fixed to opposing ends of said crossbars, respectively, and which project toward said casing; and an interlock member which is placed between said pair of projections, overlapping said crossbars in a direction parallel to said upper fitting face.

* * * * *